United States Patent [19]

Clark et al.

[11] Patent Number: 4,684,352

[45] Date of Patent: Aug. 4, 1987

[54] METHOD FOR PRODUCING A COMPOSITE SPARK PLUG CENTER ELECTRODE

[75] Inventors: Ronnie W. Clark, Ottawa Lake, Mich.; Dale P. Ameling, Bowling Green, Ohio

[73] Assignee: Champion Spark Plug Company, Toledo, Ohio

[21] Appl. No.: 817,698

[22] Filed: Jan. 13, 1986

Related U.S. Application Data

[63] Continuation-in-part of Ser. No. 710,341, Mar. 11, 1985.

[51] Int. Cl.[4] ..... H01T 21/02

[52] U.S. Cl. ..... 445/7; 72/266

[58] Field of Search ..... 445/7; 29/DIG. 47; 72/266

[56] References Cited

U.S. PATENT DOCUMENTS

| | | | |
|---|---|---|---|
| 1,521,732 | 1/1925 | Thomas | 313/144 |
| 1,789,078 | 1/1931 | McElroy | 313/142 |
| 2,371,716 | 3/1945 | Snell | 29/DIG. 47 |
| 2,849,788 | 9/1958 | Creek | 28/156.8 |
| 2,874,460 | 2/1959 | Riethmuller | 29/DIG. 47 |
| 2,945,293 | 7/1960 | Last | 29/422 |
| 2,954,495 | 9/1960 | Zeller | 313/136 |
| 2,955,222 | 10/1960 | Beesch | 313/141 |
| 3,040,417 | 6/1962 | Newton | 29/156.7 |
| 3,144,576 | 8/1964 | Hagmaier et al. | 313/141 |
| 3,234,772 | 2/1966 | Fehling et al. | 72/267 |
| 3,548,239 | 12/1970 | Eaton | 313/136 |
| 3,548,472 | 12/1970 | Urushiwara et al. | 29/25.12 |
| 3,643,322 | 2/1972 | Gerstle | 29/482 |
| 3,803,892 | 4/1974 | Yamaguchi et al. | 72/258 |
| 3,818,555 | 6/1974 | Yamaguchi et al. | 29/25.12 |
| 3,857,145 | 12/1974 | Yamaguchi et al. | 29/25.12 |
| 3,967,149 | 7/1976 | Eaton et al. | 313/141 |
| 4,526,551 | 7/1985 | Hoffmanner et al. | 445/7 |

FOREIGN PATENT DOCUMENTS

| | | | |
|---|---|---|---|
| 1052781 | 12/1957 | Fed. Rep. of Germany . | |
| 819156 | 1/1937 | France . | |
| 752963 | 7/1956 | United Kingdom | 445/7 |
| 2069378 | 8/1981 | United Kingdom . | |
| 2076706 | 12/1981 | United Kingdom . | |

*Primary Examiner*—Kenneth J. Ramsey

*Attorney, Agent, or Firm*—Oliver E. Todd, Jr.

[57] ABSTRACT

The present invention relates to a composite spark plug center electrode having a sparking tip composed of a precious or semi-precious metal and a method for producing same is disclosed. A right circular cylindrical billet of a corrosion-resistant material is initially formed into a cylindrical cup having an opened end and a closed end. A small conical recess may be formed in the center of the exterior of the closed end during the formation. A hole is next formed in the closed end of the cup. A right circular cylindrical billet of a high thermal conductivity material is next inserted within the opened end of the cup and pressed to fit tightly against the sidewall and bottom of the cup cavity to form a composite billet. An insert formed of a precious or semi-precious metal is then inserted within the hole and pressed to fit tightly therein. The opened end of the cup is formed inwardly to partially encase the billet therein. The composite billet and precious metal insert are inserted within a close-fitting bore of a die having an extrusion orifice. A plunger is inserted within the bore of the die against the filled end of the composite billet to extrude all but a terminal portion of the composite billet, adjacent the filled end thereof, through the extrusion orifice to form a center electrode blank. The opposite end of the center electrode blank containing the precious metal insert is extruded a second time to form a reduced diameter portion. Lastly, the opposite end of the center electrode blank is ground to provide a flat end surface, while the terminal end thereof is ground to provide a precise longitudinal dimension of the center electrode blank.

3 Claims, 18 Drawing Figures

METHOD FOR PRODUCING A COMPOSITE SPARK PLUG CENTER ELECTRODE

CROSS REFERENCE TO RELATED APPLICATION

This application is a continuation-in-part application of co-pending Ser. No. 710,341, filed Mar. 11, 1985, and assigned to the assignee of this application.

BACKGROUND OF THE INVENTION

1. Field Of The Invention

The present invention relates to an improved composite center electrode for a spark plug and to a method for producing same, wherein the electrode includes a sparking tip composed of a precious metal.

Because spark plugs are typically utilized in highly corrosive environments, it is desirable to form the center electrodes thereof of a material having a high degree of resistance to corrosion, such as nickel, nickel alloy, or the like. It also is desirable to have a high thermal conductivity material in the center electrode to increase the operating range for the spark plug. Accordingly, it is known to form the spark plug center electrode with an inner core of a high thermal conductivity material, such as copper, surrounded by an outer protective sheath of corrosion-resistant material. It is also known to incorporate precious or semi-precious metals in the tip of the spark plug center electrode for prolonged life. Such metals are very resistant to corrosion at the high temperatures encountered in the combustion chamber of an engine and to erosion from spark discharge. However, such precious and semi-precious metals are very expensive, and their inclusion typically requires several additional steps in the process of forming the spark plug electrode.

2. Description Of The Prior Art

U.S. Pat. No. 3,144,576 to Hagmaier et al. discloses a method for producing a composite center electrode for a spark plug by initially superposing a right circular cylindrical plate of a metal having good thermal conductivity, such as copper, upon a right circular cylindrical plate of corrosion-resistant metal, such as nickel. The superimposed plates are placed within a die and extruded therethrough to form a rod consisting of a core having good thermal conductivity within a corrosion-resistant shell.

U.S. Pat. No. 3,548,472 to Urushiwara et al. discloses another method for producing a composite center electrode for a spark plug. Initially, a right circular cylindrical billet of a corrosion-resistant metal is subjected to successive extrusions and drawings to form an elongated cup having a cavity extending therein. A right circular cylindrical billet of a metal having a relatively higher thermal conductivity is then extruded to form a core having a headed portion with a diameter equal to that of the elongated cup and a protruding portion of reduced diameter slightly less than that of the cavity. The protruding portion of the core is inserted into the cavity of the cup and pressed therein to form an integral rod, which is subjected to heat diffusion. A composite center electrode is then formed by cold working the rod to form a head thereon. Both the elongated cup and the core are worked separately to dimensions substantially the same as their final dimensions before the heat diffusion step.

U.S. Pat. No. 3,857,147 to Yamaguchi et al. discloses a method of producing a composite center electrode for a spark plug. A right circular cylindrical billet of a corrosion-resistant metal is subjected to a single extrusion step to form a cup having a cavity extending therein. A right circular cylindrical billet of a metal having good thermal conductivity is then extruded to form a cap having a headed portion with a diameter equal to that of the cup and a protruding portion of reduced diameter slightly less than that of the cavity. The protruding portion of the cap is inserted into the cavity of the cup, and both are extruded through a die to form a rod having a core of uniform diameter within a shell having walls of uniform thickness. A composite center electrode is then formed by cold working the rod to form a head thereon.

U.S. Pat. Nos. 3,868,530 and 3,967,149, both to Eaton et al., disclose a spark plug having a center electrode formed of a corrosion-resistant metal. An axial recess is formed in a flared end of the electrode, and an insert of precious metal is inserted therein to fill the recess. A swaging operation is then performed to return the flared end of the center electrode to a cylindrical configuration and thereby retain the precious metal inserts therein.

Other related processes and constructions are described and illustrated in U.S. Pat. Nos. 1,521,732 to Thomas, 1,789,078 to McElroy, 2,849,788 to Creek, 2,945,293 to Last, 2,954,495 to Zeller, 2,955,222 to Beesch, 3,040,417 to Newton, 3,548,239 to Eaton, 3,643,322 to Gerstle, 3,803,892 to Yamaguchi et al., and 3,818,555 to Yamaguchi et al., and also in French Pat. No. 819,156 and German Pat. No. 1,052,781.

SUMMARY OF THE INVENTION

The present invention relates to a composite spark plug center electrode having a sparking tip composed of a precious or semi-precious metal and a method for producing same. A right circular cylindrical billet of a corrosion-resistant material is initially formed into a cylindrical cup having an opened end and a closed end. A small conical recess may be formed in the center of the exterior of the closed end during the formation of the cup. A right circular cylindrical billet of a high thermal conductivity material is next inserted within the opened end of the cup and pressed to fit tightly against the sidewall and bottom of the cup cavity to form a composite billet. A hole is then formed in the closed end of the composite billet through the conical recess, and an insert formed of a precious or semi-precious metal is inserted therein. The composite billet and precious metal insert are inserted within a close-fitting bore of a die having an extrusion orifice. A plunger is inserted within the bore of the die against the filled end of the composite billet to extrude all but a terminal portion of the composite billet, adjacent the filled end thereof, through the extrusion orifice to form a center electrode blank.

In an alternate embodiment of the invention, the cylindrical cup is initially formed as described above. A hole is next formed in the closed end of the cup. A right circular cylindrical billet of a high thermal conductivity material is next inserted within the opened end of the cup and pressed to fit tightly against the sidewall and bottom of the cup cavity to form a composite billet. An insert formed of a precious or semi-precious metal is then inserted within the hole and pressed to fit tightly therein. The opened end of the cup is formed inwardly to partially encase the billet therein. The composite billet and precious metal insert are inserted within a close-fitting bore of a die having an extrusion orifice. A plunger is inserted within the bore of the die against the filled end of the composite billet to extrude all but a terminal portion of the composite billet, adjacent the filled end thereof, through the extrusion orifice to form a center electrode blank. The opposite end of the center electrode blank containing the precious metal insert is extruded a second time to form a reduced diameter portion. Lastly, the opposite end of the center electrode blank is ground to provide a flat end surface, while the terminal end thereof is ground to provide a precise longitudinal dimension of the center electrode blank.

It is an object of the present invention to provide an improved composite spark plug center electrode having a sparking tip composed of a precious or semi-precious metal, and a method for producing same.

Other objects and advantages of the present invention will become apparent to those skilled in the art from the following detailed description of the preferred embodiments, when read in light of the accompanying drawings.

DETAILED DESCRIPTION OF THE PREFERRED EMBODIMENTS

Referring now to FIGS. 1 through 9, there is illustrated a method for producing an improved composite center electrode for a spark plug. The apparatus and method of the present invention are related to co-pending patent application Ser. No. 547,956 to Hoffmanner et al., filed Nov. 2, 1983, and assigned to the assignee of the present application. The disclosure of that application is hereby incorporated by reference.

Figure 1:
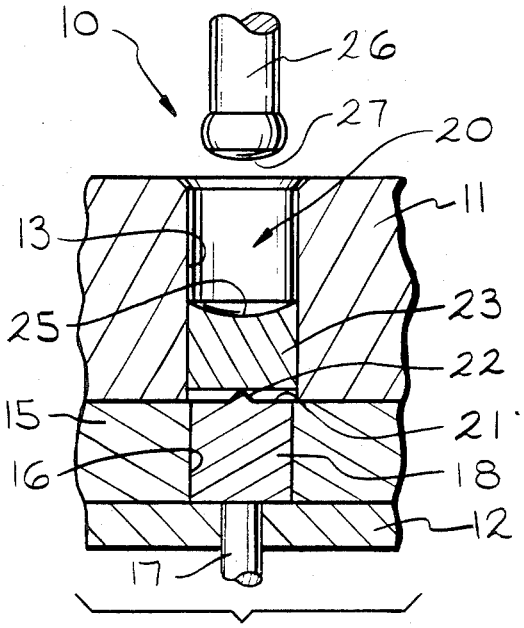
FIG. 1 is a sectional elevational view schematically illustrating a right circular cylindrical billet of a corrosion-resistant material within a composite die of an extruder, prior to the extrusion operation.

As illustrated in FIG. 1, an extruder, indicated generally at 10, comprises a composite die 11 positioned on a platen 12. The composite die 11 includes a right circular cylindrical upper bore 13 extending downwardly therein to a lower die portion 15 having a slightly smaller aligned lower bore 16 extending therethrough. A piston 17 extends through an aperture formed in the platen 12 into structural relationship with a floating ejector 18, which fills the lower bore 16 of the composite die 11. A cavity, indicated generally at 20, is formed by a sidewall of the upper bore 13 and an upper surface 21 of the floating ejector 18. If desired, the upper surface 21 of the floating ejector 18 may be formed with a central conical boss 22 for purposes hereafter described.

Figure 2:
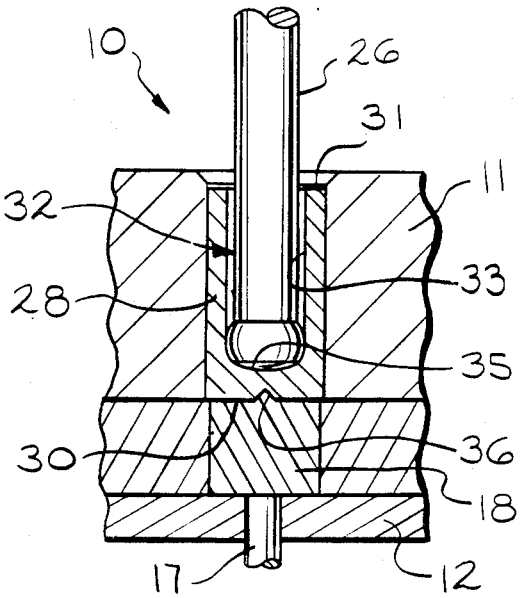
FIG. 2 is a sectional elevational view similar to FIG. 1 illustrating the billet after being pierced and extruded to form a cup.

The first step of the method of the present invention involves the formation of a right circular cylindrical billet 23 of a corrosion-resistant material into a cup. The billet 23 can consist of a nickel or nickel alloy metal, which can be formed by drilling or extrusion. In the preferred embodiment, the billet 23 is inserted within the upper bore 13 of the composite die 11. The billet 23 may have an upper concave end 25 or a generally flat end and is sized to fit within and conform with the sidewall of the bore 13. A plunger 26 having a lower convex face 27 is then inserted into the cavity 21 against the upper end 25 of the billet 23. Referring to FIG. 2, pressure is applied by the plunger 26 so as to pierce the billet 23 and cause extrusion thereof to form a cup 28 having a closed end 30, an opened end 31, and a cavity indicated generally at 32 defined by an inner sidewall 33 extending concentrically therein to a lower concave surface 35. A conical recess 36 is shown formed in the exterior surface of the closed cup end 30 by the conical boss 22 of the floating ejector 18 during the back-extrusion process.

Figure 3:
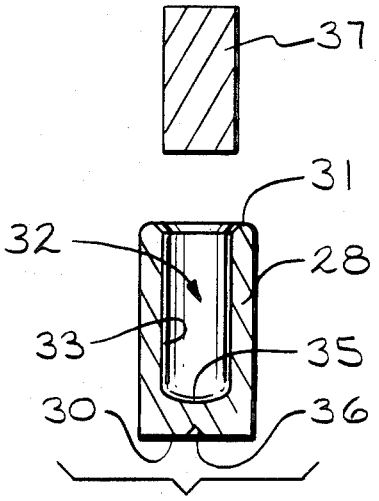
FIG. 3 is a sectional elevational view schematically illustrating the extruded cup of FIG. 2 and a right circular cylindrical billet of a high thermal conductivity material, prior to the billet being inserted within the cavity of the cup.
Figure 4:
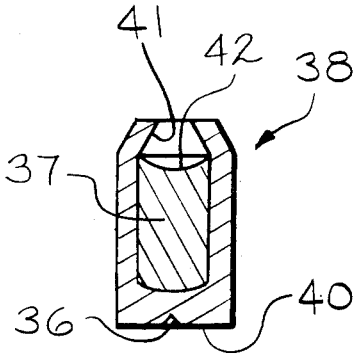
FIG. 4 is a sectional elevational view similar to FIG. 3 illustrating the billet after being inserted within the cavity of the cup and compressed therein to form a composite billet.

The next step of the method of the present invention involves the formation of a composite billet. Referring to FIG. 3, a close-fitting, right circular cylindrical billet 37 of a high thermal conductivity material is inserted through the opened end 31 of the cup 28. In the preferred embodiment, the billet 37 is formed of copper and is compressed within the cavity 32 of the cup 28 to force the lower end and cylindrical sidewall thereof into close-fitting relationship with the lower concave surface 35 and sidewall 33, respectively, of the cup 28. This step forms a composite billet, indicated generally at 38 in FIG. 4, having a closed end 40 and an opened end 41. The billet 37 may be formed to have an end 42 recessed from the opened end 41. The opened end 41 also may be formed inwardly to partially encase the copper billet 37 within the nickel or nickel alloy cup 28.

Figure 5:
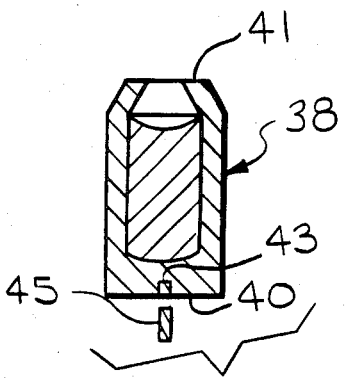
FIG. 5 is a sectional elevational view schematically illustrating the composite billet of FIG. 4 after a hole has been formed in the closed end thereof and an insert of a precious or semi-precious metal, prior to the insert being inserted within the hole.
Figure 6:
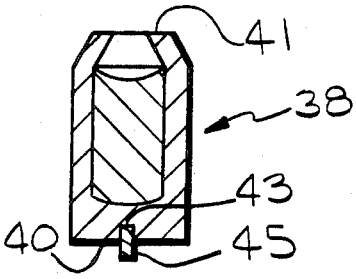
FIG. 6 is a sectional elevational view illustrating the composite billet of FIG. 5 after the insert has been inserted within the hole.

The next step of the method of the present invention involves the addition of an insert of a precious or semi-precious metal to the composite billet 38. Referring to FIGS. 5 and 6, a small hole 43 is formed in the center of the exterior surface of the closed end 40 of the composite billet 38 in the region of the conical recess 36. The hole 43 can be formed by drilling or any other suitable means. The conical recess 36 is provided in the closed end 40 for easily locating a drill bit or other means in the proper location for forming the hole 43. An insert 45 formed of a precious or semi-precious metal is then inserted within the hole 43. The insert 45 is a short piece of wire having approximately the same cross-sectional dimensions as the hole 43 so as to fit therein and minimize or eliminate any open spaces. In the illustrated embodiment, only a portion of the insert 45 fits within the hole 43, the other portion of the insert 45 extending longitudinally outwardly therefrom. However, if desired, the insert 45 can be formed to fit completely within the hole 43. In either case, the insert is positioned to contact the bottom of the hole 43. The insert 45 can be formed of platinum, iridium, or the like.

Figure 7:
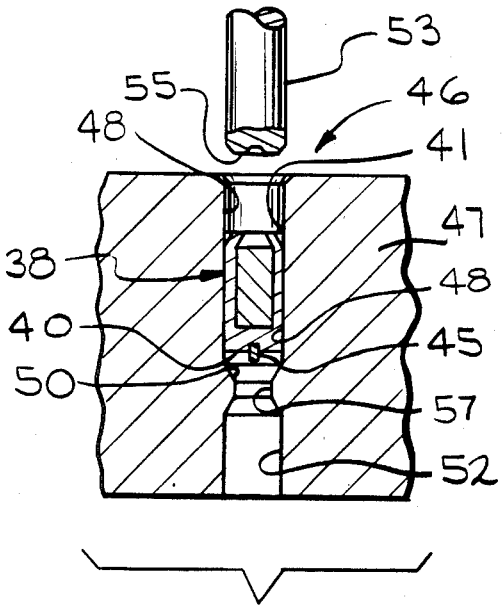
FIG. 7 is a sectional elevational view illustrating the composite billet of FIG. 6 inserted within the bore of an extrusion die, prior to the extrusion operation.
Figure 8:
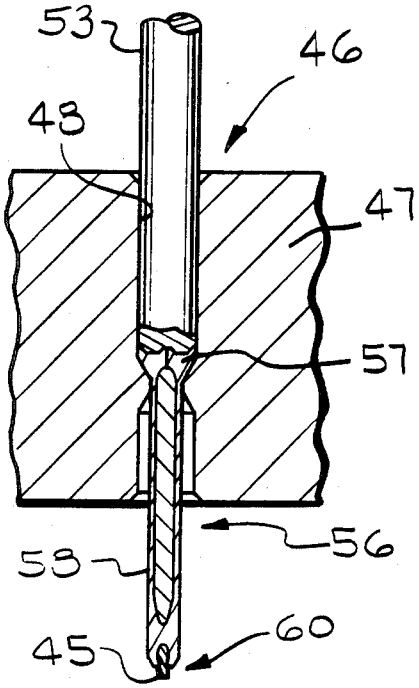
FIG. 8 is a sectional elevational view similar to FIG. 7 showing the composite billet in the extrusion die after extrusion of all but a terminal portion of the composite billet.

The final step of the method of the present invention involves the formation of a center electrode blank from the composite billet 38 containing the insert 45. Referring to FIGS. 7 and 8, an extruder 46 comprises a die 47 having a right circular cylindrical upper bore 48 extending downwardly therein to a shoulder 50, and reducing in diameter to form an extrusion orifice 51, which then enlarges in diameter to a lower bore 52 extending therethrough. The upper bore 48 has a diameter sufficiently large to receive the composite billet 38 containing the insert 45 in close-fitting relationship. The extruder 46 also includes a plunger 53 having a diameter equal to that of the upper bore 48 and insertable therein. The plunger 53 may include a shaped end 55 for forming a head or terminal end 57 on the extruded electrode blank 56, as illustrated in FIG. 8.

The closed end 40 of the composite billet 38 is initially inserted in the upper bore 48 of the die 47. Pressure is applied to the plunger 53 so as to force all of the composite billet 38, except a terminal portion adjacent to the open end 41, through the extrusion orifice 51 to form an electrode blank, indicated generally at 56. The electrode blank 56 has an unextruded terminal head end 57 and a rod portion 58 of reduced diameter extending longitudinally therefrom as a lower portion terminating in a tip indicated generally at 60. The rod 58 has a diameter equal to that of the extrusion orifice 51 and a length substantially greater than that of the composite billet 38. As illustrated in FIG. 8, the rod 58 includes an elongated inner core of the high thermal conductivity material surrounded on its sides, on the tip 60, and at the terminal end 57 by an outer protective sheath of the corrosion-resistant material. The electrode blank 56 can then be removed from the die 47 through the upper bore 48 thereof.

Because the tip 60 of the electrode blank 56 is also smaller in diameter than the unextruded composite billet 38, the portion of the insert 45 inserted therein is compressed during the extrusion process. Such compression causes any open spaces which remained after the insert 45 was inserted in the hole 43 to be eliminated. Additionally, a slightly enlarged portion 65 of the insert 45 is formed in the interior of the tip 60 during the extrusion process. The diameter of the enlarged portion 65 is larger than the diameter of the insert 45 at the tip 61. As a result, the insert 45 is securely retained within the hole 43 to prevent the removal thereof.

Figure 9:
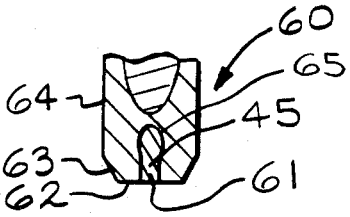
FIG. 9 is a fragmentary sectional elevational view illustrating a modified center electrode wherein the tip of the precious metal insert is flush with the bottom of the center electrode blank.
Figure 10:
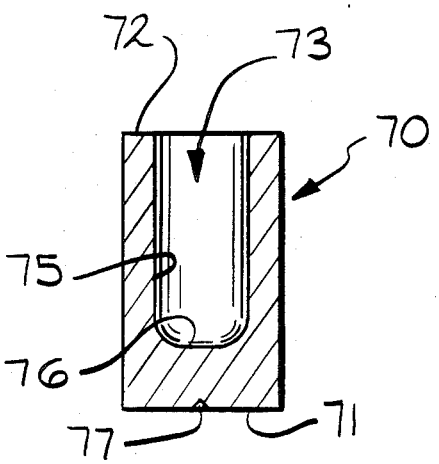
FIG. 10 is a sectional elevational view schematically illustrating an extruded cup similar to that illustrated in FIG. 3 for use in an alternate method for producing an improved composite center electrode for a spark plug in accordance with the present invention.

As illustrated in FIG. 8, a portion of the insert 45 extends longitudinally outwardly from the tip 60 of the rod after the extrusion process is completed. It has been found acceptable to maintain this portion of the insert 45 in its exposed condition for use in a spark plug. Alternately, the insert 45 may be sized to be retained completely within the hole 43 prior to extrusion. By properly sizing the insert 45, the bottom end 61 of the insert 45 will be formed flush with a bottom end 62 of the tip 60, as illustrated in FIG. 9. A slight taper 63 may be formed between a cylindrical sidewall 64 at the electrode tip 60 and the end 62. The taper 63 serves primarily to distinguish the center electrode with the insert 45 from a conventional center electrode, since the insert 45 may be of substantially the same color as the adjacent metal and not readily visible. The unextruded terminal end 57 of the center electrode blank 56 in FIG. 8 can be processed to form any desired shape for use in a spark plug. Several examples of how the terminal end portion 57 can be shaped are disclosed in the above-referenced patent application. However, such processing does not form a part of the present invention.

Figure 11:
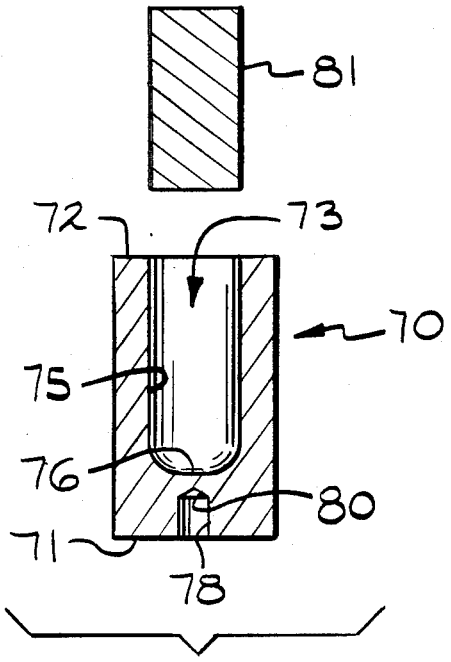
FIG. 11 is a sectional elevational view schematically illustrating the cup of FIG. 10, after a hole has been drilled in the closed end thereof, and a right circular cylindrical billet of a high thermal conductivity material, prior to the billet being inserted within the cavity of the cup.

Referring now to FIGS. 10 through 18, there is illustrated an alternate method for producing an improved composite center electrode for a spark plug. A cup, indicated generally at 70, is formed of a corrosion-resistant material as described above in connection with FIGS. 1 and 2. The cup 70 has a closed end 71, an opened end 72, and an interior cavity indicated generally at 73. The cavity is defined by a cylindrical inner sidewall 75 extending concentrically therein to a lower concave surface 76. A conical recess 77 is formed in the exterior surface of the closed end 71 of the cup 70. As shown in FIG. 11, the next step of the method of the present invention involves the formation of a hole 78 in the exterior surface of the closed end 71 of the cup 70. The hole 78 can be formed by drilling, as described above, and can include a tapered end portion 80 formed as a result of such drilling.

Figure 12:
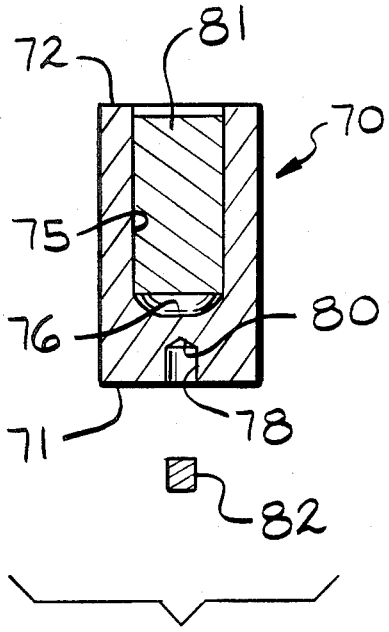
FIG. 12 is a sectional elevational view schematically illustrating the billet after being inserted within the cavity of the cup and an insert of a precious or semi-precious metal, prior to the insert being inserted within the hole.

A close-fitting, right circular cylindrical billet 81 of a high thermal conductivity material, such as copper, is initially co-axially aligned with the cavity 73, as shown in FIG. 11. The billet 81 is inserted within the cavity 73 of the cup 70 through the opened end 72 thereof. As shown in FIG. 12, the length of the billet 81 is slightly less than the length of the inner sidewall 75, such that the billet 81 is recessed somewhat below the opened end 72 of the cup 70 when it is inserted in the cavity 73. The recessed area between the opened end 72 of the cup 70 and the billet 81 is provided to permit a plunger (not shown) to be easily located against the billet 81 to press it further within the cavity 73 of the cup 70.

Figure 13:
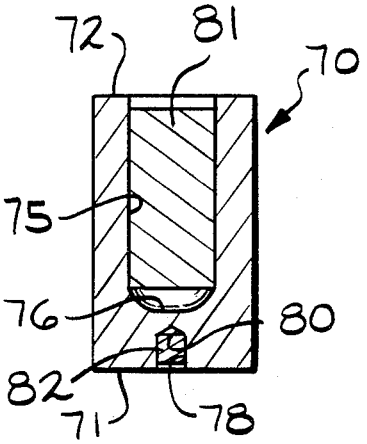
FIG. 13 is a sectional elevational view schematically illustrating the insert after being inserted within the hole.
Figure 14:
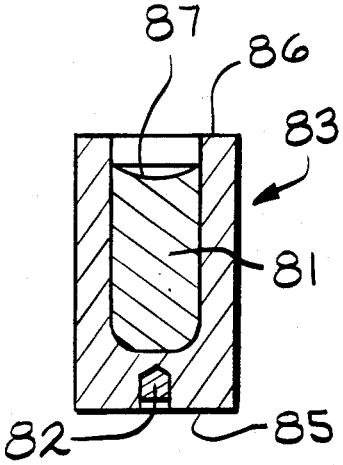
FIG. 14 is a sectional elevational view similar to FIG. 13 illustrating the insert after being compressed within the hole.
Figure 15:
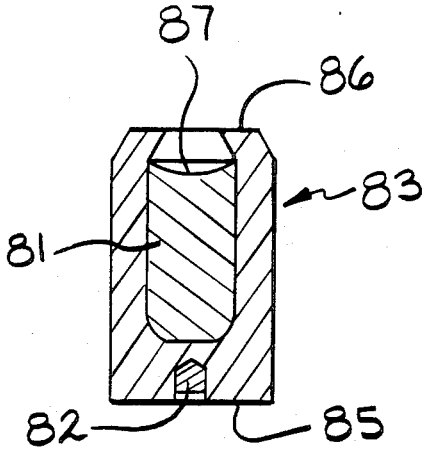
FIG. 15 is a sectional elevational view similar to FIG. 14 illustrating the billet after being compressed within the cavity of the cup to form a composite billet.

An insert 82 of a precious or semi-precious material is next co-axially aligned with the hole 78 and inserted therein, as illustrated in FIGS. 12 and 13. The length of the insert 78 is slightly less than the length of the hole 78, such that a recessed area is provided between the end of the insert 78 and the closed end 71 of the cup 70, for the same reason mentioned above in connection with the billet 81. As shown in FIG. 14, the billet 81 and the insert 82 are pressed within the cavity 73 and the hole 78, respectively, to form a composite billet 83. The composite billet 83 includes a closed end 85 and an opened end 86. The billet 81 may be formed to have an end 87 recessed from the opened end 86. The opened end 86 of the composite billet 83 may then be formed inwardly, as illustrated at FIG. 15, to partially encase the billet 81 therein.

Figure 16:
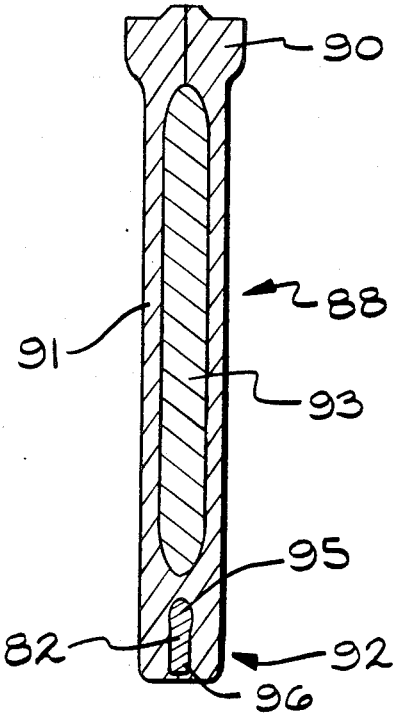
FIG. 16 is a sectional elevational view schematically illustrating a center electrode blank formed by extrusion of all but a terminal portion of the composite billet illustrated in FIG. 15.

The next step of the alternate method of the present invention involves the extrusion of the composite billet 83 to form a center electrode blank. This extrusion step can be performed on a conventional extruder, such as described above and illustrated generally at 46. As a result of such extrusion, a center electrode blank, illustrated generally at 88 in FIG. 16, is formed. The electrode blank 88 includes an unextruded terminal head portion 90, a rod portion 91 having a reduced diameter, and a tip indicated generally at 92. The rod portion 91 has a diameter equal to that of the extrusion orifice 51 and a length substantially greater than that of the composite billet 83. An elongated inner core 93 of the high thermal conductivity material from the billet 81 is enclosed within the rod portion 91. Because the tip 92 of the electrode blank 88 is smaller in diameter than the composite billet 83, the insert 82 is compressed therein during the extrusion process. As a result of such compression, the insert 82 is formed with an enlarged interior portion 95 within the electrode blank 88. The diameter of the enlarged portion 95 is larger than the diameter of the insert 82 at the tip 92. As a result, the insert 82 is securely retained within the hole 78 to prevent the removal thereof. Also, since the insert 82 was initially recessed within the composite billet 81, as shown in FIG. 15 before extrusion, the tip 92 of the electrode blank 88 will completely enclose a tip 96 of the insert 82, located opposite the enlarged portion 95 thereof, during the extrusion process.

Figure 17:
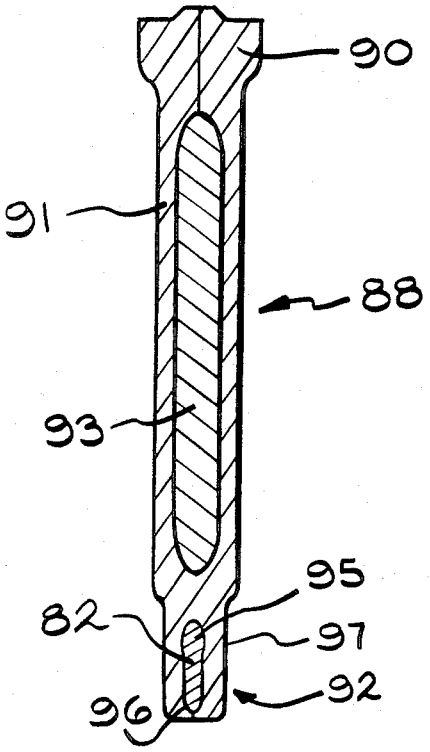
FIG. 17 is a sectional elevational view similar to FIG. 16 after the tip of the center electrode blank has been subjected to a second extrusion.

Depending upon the size of the insulator within which the electrode blank 88 is to be inserted, it may be desirable to subject the tip 92 of the electrode blank 88 to a second extrusion process. As illustrated in FIG. 17, the tip 92 has been extruded through an orifice (not shown) having a diameter which is slightly smaller than the extrusion orifice 51 utilized to form the electrode blank 88. As a result, the tip 92 is provided with a further reduced diameter portion 97 which is smaller in diameter than the rod portion 91, and the enlarged portion 95 of the insert 82 is again enlarged. The second extrusion process is necessary to provide a gap between the tip 92 of the electrode blank and the ceramic insulator (not shown) which will eventually surround it. As is well known, the tip 92 will conduct large amounts of electricity when the spark plug is in use. Such conduction of electricity generates heat which causes the metal portions of the tip 92 to expand. If the tip 92 was not extruded to provide the reduced diameter portion 97, the tip 92 would expand against the relatively unexpandable ceramic insulator surrounding it, causing the insulator to fracture.

Figure 18:
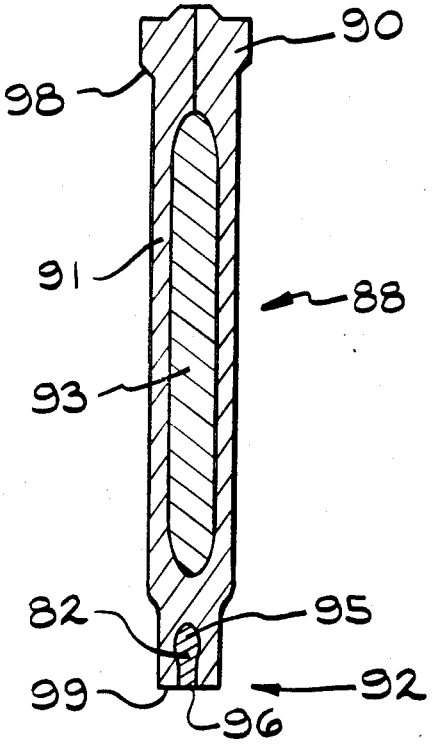
FIG. 18 is a sectional elevational view similar to FIG. 17 illustrating the center electrode blank after the tip and terminal portions thereof have been subjected to grinding operations.

The last step of the alternate method of the present invention involves the grinding of the terminal head portion 90 to expose the tip portion 92 of the electrode blank 88. As shown in FIG. 18, the terminal head portion 90 is ground to define a flat shoulder portion 98, while the tip portion 92 is ground to a flat end 99. Such grinding may be accomplished in any known manner and is performed to provide a precise longitudinal dimension from the shoulder 98 to the flat end 99.

Minor variations may be made in the above-described alternate method of the present invention. For example, the drilling of the hole 78 may be performed after the billet 81 has been inserted within the cavity 73 of the cup 70. Also, the billet 81 and the insert 82 may be pressed into the cavity 73 and the hole 78, respectively, at other points in the method than those illustrated. In accordance with the provisions of the patent statutes, the principle and mode of operation of the present invention has been described and illustrated in its preferred embodiments. However, it must be appreciated that the present invention can be practiced otherwise than as specifically explained and illustrated without departing from its spirit or scope.

What is claimed is:

1. A method for producing a composite spark plug center electrode blank comprising the steps of:

a. forming a composite billet comprising a cup of a corrosion-resistant metal defining a cavity at least partially filled with a material having a high thermal conductivity, said cup having a closed end with an exterior surface defining a hole;

b. positioning a cylindrical wire insert of one of a precious and semi-precious metal into the hole;

c. pressing between said billet and said insert to retain said insert in the hole, wherein said insert is completely retained within the hole and is recessed from said exterior cup surface prior to extrusion; and d. extruding at least a portion of the composite billet closed end first through an extrusion orifice, whereby a center electrode blank having an inner core of a high thermal conductivity material surrounded by an outer sheath of a corrosion-resistant material is formed, the blank having an extruded tip end having at least a portion of the insert retained therein and having an unextruded terminal end.

2. The method defined in claim 1, and further including the step of grinding the extruded tip end to provide a predetermined longitudinal dimension between the extruded tip end and the terminal end and to make said insert flush with the extruded tip end of the extruded electrode blank.

3. The method defined in claim 1, and further including the step of extruding at least a portion of the extruded tip end of the blank through a second extrusion orifice smaller in diameter than the first extrusion orifice, whereby the tip of the blank is formed with a reduced diameter portion.

* * * * *